US005236105A

United States Patent [19]

Galex

[11] Patent Number: 5,236,105

[45] Date of Patent: Aug. 17, 1993

[54] METHOD OF PREVENTING OVER-EJECTION OF COMPOUND FROM A CAULKING GUN

[76] Inventor: Gerald J. Galex, 220 Wimbledon Lake Dr., Plantation, Fla. 33324

[21] Appl. No.: 886,590

[22] Filed: May 21, 1992

[51] Int. Cl.[5] ..... B67D 5/42

[52] U.S. Cl. ..... 222/1; 222/391; 222/327

[58] Field of Search ..... 222/1, 391, 326, 327, 222/386, 571

[56] References Cited

U.S. PATENT DOCUMENTS

| | | | |
|---|---|---|---|
| 2,582,156 | 1/1952 | Peterson | 222/391 X |
| 2,652,955 | 9/1953 | Crewe | 222/391 X |
| 2,776,075 | 1/1957 | Etter | 222/391 X |
| 2,778,541 | 1/1957 | Sherbondy | 222/391 X |
| 2,786,604 | 3/1957 | Collins | 222/391 X |
| 4,009,804 | 3/1977 | Costa et al. | 222/391 |
| 4,072,254 | 2/1978 | Cox | 222/391 |
| 4,090,639 | 5/1978 | Campbell et al. | 222/391 X |
| 4,461,407 | 7/1984 | Finnegan | 222/391 |
| 4,572,409 | 2/1986 | Finnegan | 222/391 |
| 4,678,107 | 7/1987 | Ennis, III | 222/571 X |
| 4,681,524 | 7/1987 | Ikeda et al. | 222/391 X |
| 4,706,853 | 11/1987 | Stonesifer et al. | 222/391 |
| 4,923,096 | 5/1990 | Ennis, III | 222/571 X |

*Primary Examiner*—Kevin P. Shaver
*Attorney, Agent, or Firm*—M. K. Silverman

[57] ABSTRACT

A method of preventing over ejection of material from a caulking canister of a caulking system having an ejection member passing through a body of the caulking system includes the steps of securing a female element to a moveable backplate of the caulking canister, securing a male element complemental to the female element to an end of the ejection member normally in contact with the moveable plate, and securing between the system body and an opposite end of the ejection member, after mutual securement of the male and female elements, spring to selectably urge the plate away from the caulking canister to cause within the canister a relative vacuum. The effect of such relative vacuum is to prevent over-ejection, also known as oozing, of caulking material from the dispensing nozzle of the caulking gun.

6 Claims, 4 Drawing Sheets

METHOD OF PREVENTING OVER-EJECTION OF COMPOUND FROM A CAULKING GUN

REFERENCE OF THE INVENTION

This application is directed to substantially the same subject matter as Disclosure Document Numbers 306654 and 306677, filed Apr. 23 and Apr. 24, 1992 respectively.

BACKGROUND OF THE INVENTION

As is well-known to both professional construction people and home handymen, so-called caulking guns of the type presently available in the marketplace suffer from the problem of over-ejection, colloquially known as oozing, from the nozzle of the caulking canister after pressure on the canister has been removed. Because of such over-ejection of compound from the caulking gun canister, an additional and often time-consuming step is typically added to the caulking process.

To the knowledge of the inventor there does not exist any prior art which has sought to address the problem of over ejection of material from a caulking canister.

It is in response to the above set forth problems of the prior art that the instant invention is directed.

SUMMARY OF THE INVENTION

The instant invention relates to a method of preventing over ejection of material from a caulking canister of a caulking system having an ejection member passing through a body of the caulking system and gun.

The inventive method include the steps of securing a female element to a moveable backplate of the caulking canister, securing a male element complementally attachable to said female element to an end of said ejection member normally in contact with said moveable plate, and securing, between said gun body and an opposite end of said ejection member, spring means to, after attachment of said male and female elements selectably urge said plate away from said caulking canister to thereby cause within the canister a relative vacuum. The effect of such relative vacuum is to prevent over-ejection, also known as oozing, of caulking material from the dispensing nozzle of the caulking canister.

It is accordingly an object of the present invention to provide a method and system which addresses the problem of over-ejection of caulking compound from caulking systems.

It is another object of the present invention to provide a system of the above type which can be implemented by retro-fitting of existing caulking guns.

It is a further object of the present invention to provide a method and system of the above type through which various designs of caulking gun systems may be retro-fitted.

A yet further object is to provide enhanced stability of the caulking canister relative to the caulking gun.

The above and yet other objects and advantages of the present invention will become apparent from the hereinafter set forth Brief Description of the Drawings, Detailed Description of the Invention and Claims appended herewith.

DETAILED DESCRIPTION OF THE INVENTION

Figure 1:
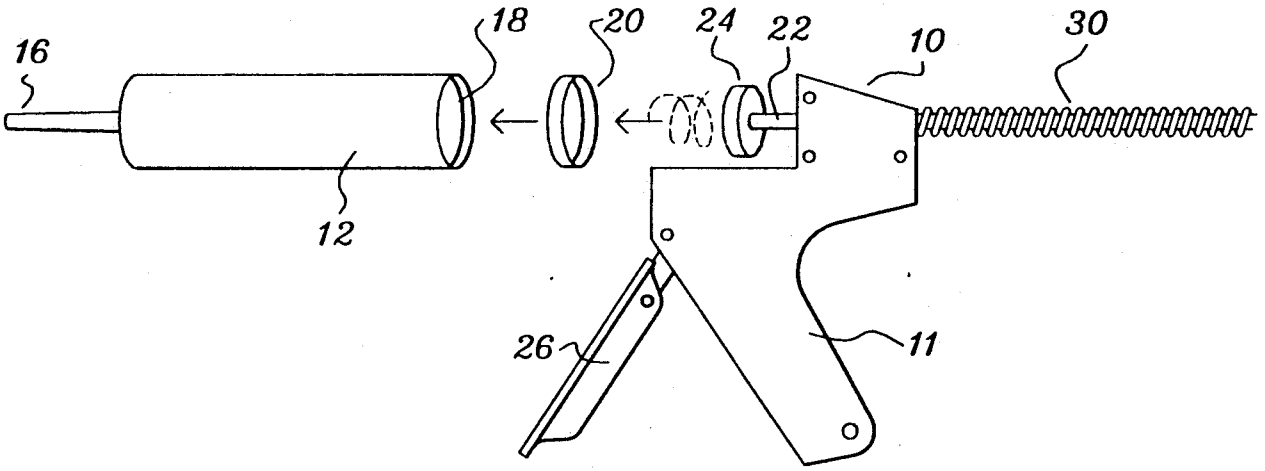
FIG. 1 is an exploded view of a first embodiment of the invention.
Figure 2:
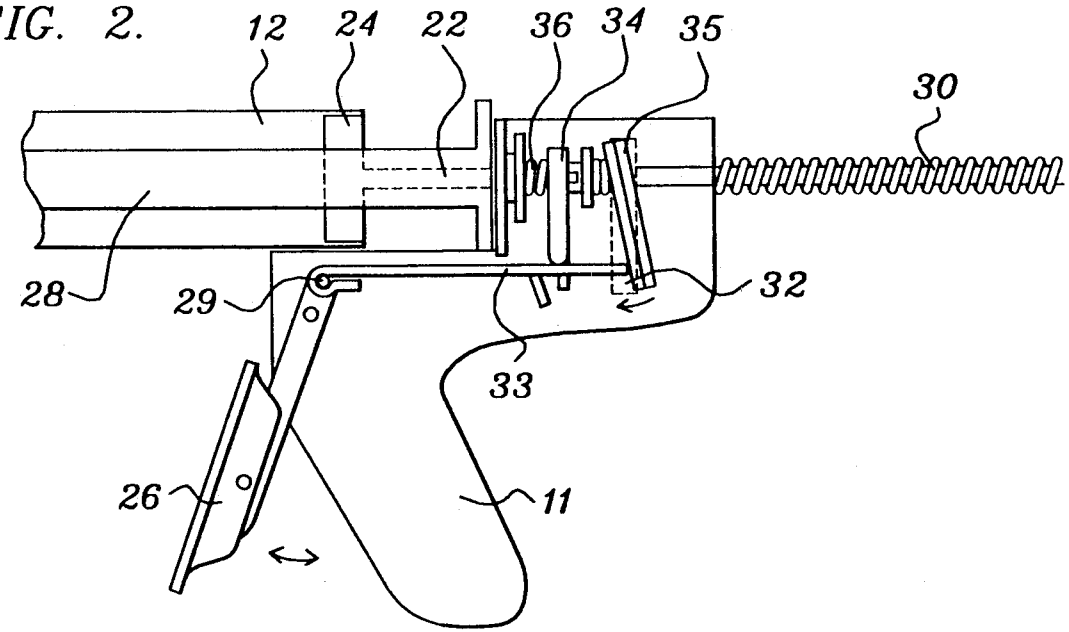
FIG. 2 is a breakaway view showing the components of the ejection member advance mechanism of the embodiment of FIG. 1.

With reference to FIGS. 1 and 2 there is shown the instant inventive method as applied to a first type of caulking gun 10. Therein is shown a caulking canister 12 having a nozzle 16, from which ejection of caulking compound typically occurs, said canister having a back plate 18 which is advanced toward nozzle 16 in the norma manner of prior art caulking guns. In other words, plate 18 is moveable relative to the lateral cylindrical walls of caulking canister 12.

In accordance with the present inventive method and system a female element 20 is provided for permanent securement against said back plate 18, as by bonding thereto. Mounted upon ejection member 22 is a male element 24 proportioned for complemental insertion within said female element 20. The dotted spiral lines in FIG. 1 between said elements 20 and 24 indicate that, in one embodiment, connection between the male and female elements is achieved through the mutual threading of complementally pitched threads on the inside of female element 20 and on the outside of male element 24, prior to use of the system.

Figure 1A:
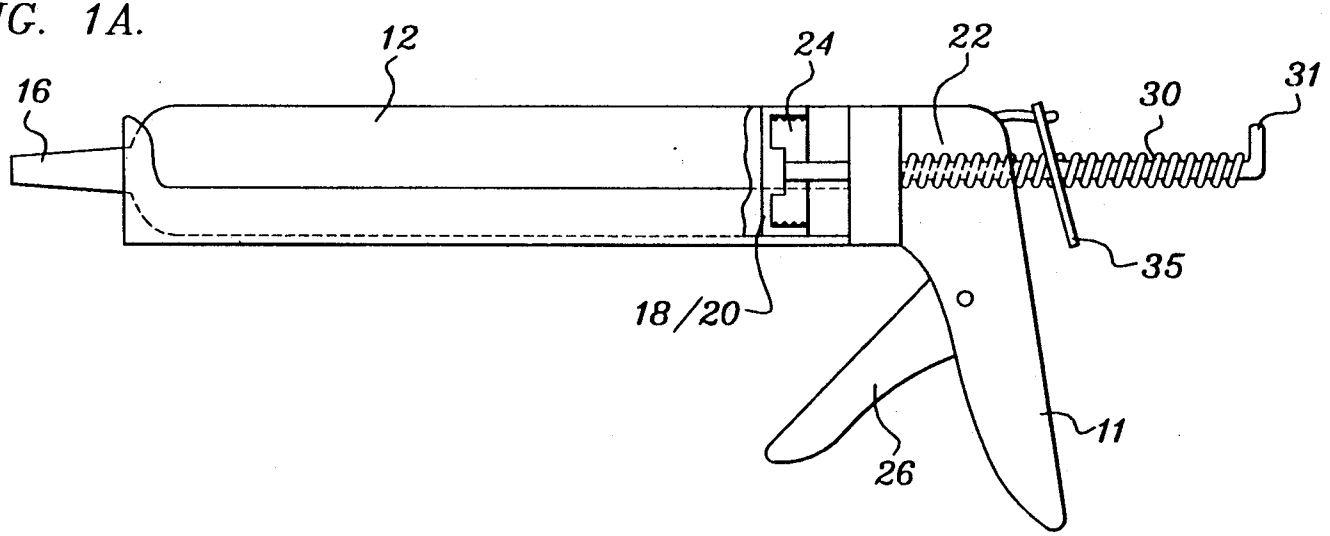
FIGS. 1A and 1B are respective side and top schematic views of the first embodiment of the invention showing, particularly, the threaded connection between the male and female elements therein.
Figure 1B:
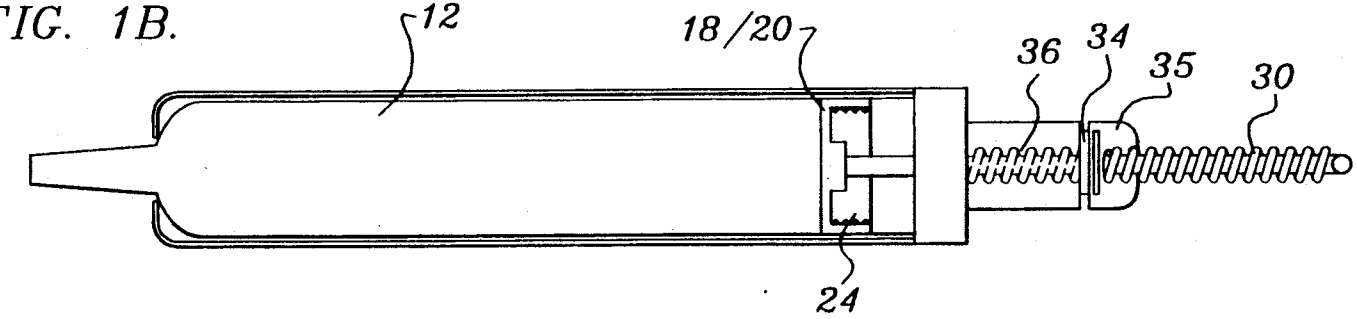

FIGS. 1A and 1B are respective side and top schematic views of the system of FIG. 1 showing, particularly, the complemental threading of female element 20 and male element 24. Also, back plate 18 and female element 20 are shown as single integral element which is the result of either bonding the elements together, as above noted, or of manufacturing the elements as a single unit, as is more fully set forth below.

Figure 3:
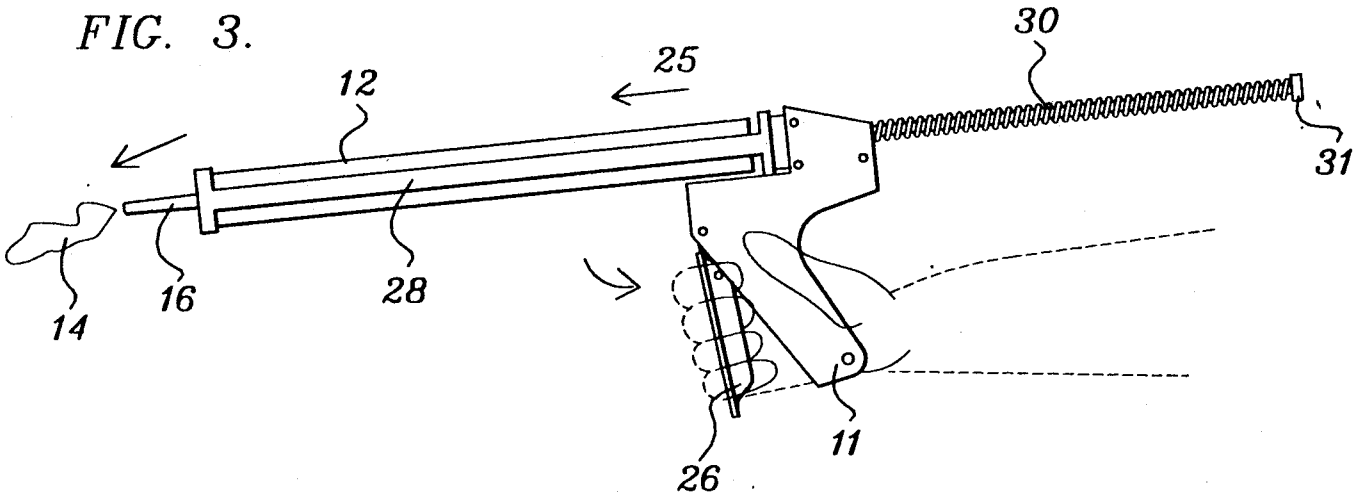
FIG. 3 is an operational view showing advance of the ejection member and discharge of caulking compound.
Figure 4:
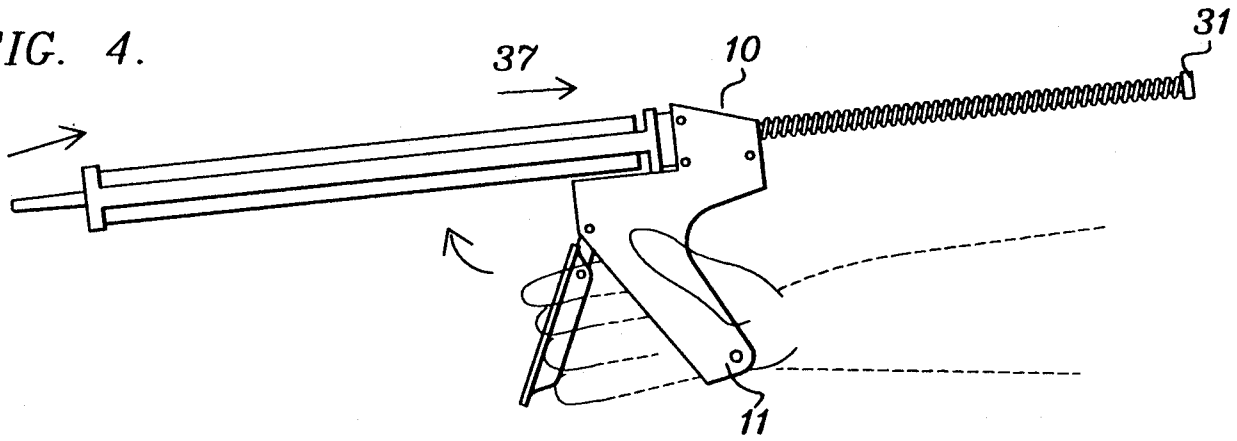
FIG. 4 is a perspective operational view showing retraction of the ejection member.

Shown to the right of handle 11 of caulking gun 10 is spring means 30 which, in the manner shown in FIG. 3, is secured between caulking Sun 10 and stop 31.

The inside mechanism of the caulking gun of FIG. 1 is shown in FIG. 2. Said mechanism, while important to an understanding of the instant invention, comprises the prior art of caulking gun mechanism. In other words, the instant inventive method is that of retro-fitting, with said elements 20, 24, 30 and 31, an otherwise conventional caulking gun structure. With the foregoing in mind, it may be appreciated that the caulking gun shown in FIGS. 1 thru 4 operates through the application of hand pressure to handle 26 relative to handle 11 such that handle 26 will rotate relative to pivot point 29 (which includes a coil spring not shown) thereby urging element 32 to rotate in the direction indicated by the curved arrow beneath element 32. The effect thereof is to cause element 34 to move forward, applying pressure to spring 36 such that ejection member 22 will be urged forward in the direction indicated by the arrow 25 above male element 24 in FIG. 3.

In the typical prior art use of caulking guns, handle 26 is continually squeezed relative to handle 11 in the manner shown in FIG 3. such that caulking compound 14 is ejected from nozzle 16. However, as noted in the Background of the Invention above, a short coming in the prior art of caulking guns is that a "time constant" exists within the canister 12 so that caulking compound 14 will not begin to be ejected until handle 26 has been pumped two or three times. Resultingly, because of the build-up of pressure in the canister caulking compound 14 will continue to ooze out of nozzle 16 even after the reciprocating motion of handle 26 shown into FIG. 3 has stopped.

The instant inventive method and system address the above problem by providing an arrangement of mechanical parts in which the release of handle 26 (see FIG. 4) will result in tops of element 32 (see FIG. 2) tilting forward such that the friction of the interior diameter of hole 35 in element 32 against the ejection member 22 (about which spring 30 is spiraled) will be removed. Thereby, in the absence of friction between the walls of hole 35 of element 32 and ejection member 22 the kinetic energy of spring 30 will expand the spring between stop 31 and the gun 10 in the direction shown by arrow 37 of FIG. 4. This abrupt movement to the right indicated by arrow 37 operates to Pull the above described combination of male and female elements 20 and 24 to the right thereby creating a relative vacuum within caulking canister 12. The effect thereof is to counteract the internal pressures within the canister 12 which have built up as a result of the movement of the lifting member 22 caused by the reciprocating movement of handle 26 shown in FIG. 3. Stated otherwise, the "time constant" of the caulking compound within canister 12 is changed by the application of negative Pressure caused by the expansive movement of plate 18. Thereby, ejection of compound 14 from nozzle 16 is immediately stopped by the above process.

It is noted that, in lieu of the use of spring 30, a user may simply pull distal end 31 (see FIG. 3) of pusher member 22 to the right, thereby enabling the rapid expansion of spring 36 to the right and, with it, release of enough kinetic energy to perform the above-described function of spring 30.

Figure 5:
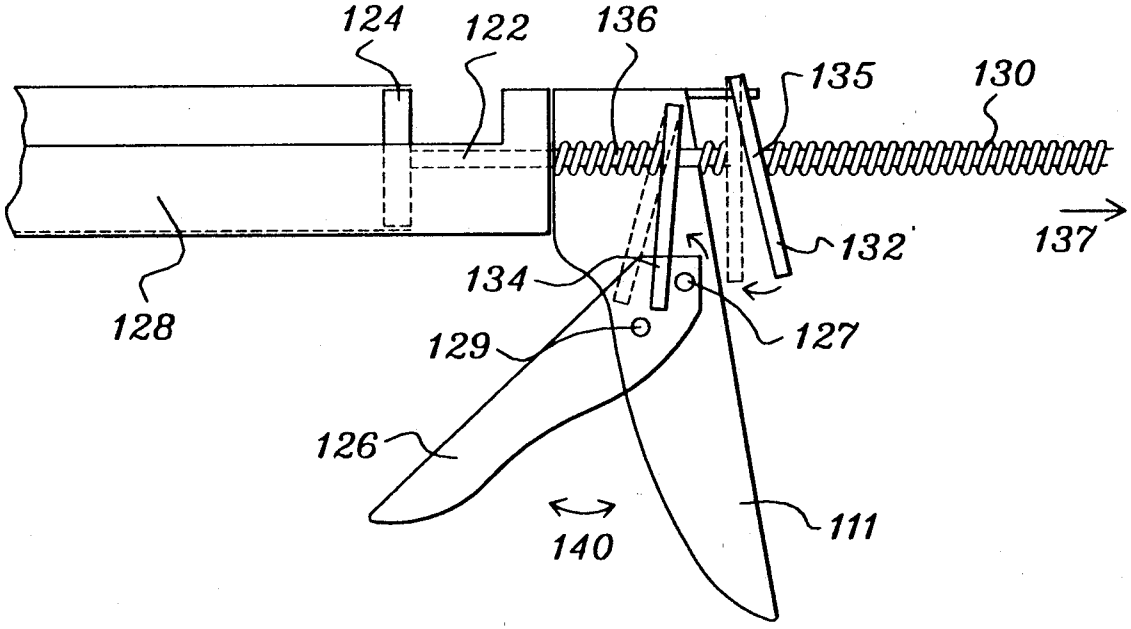
FIG. 5 is a view, similar to the view of FIG. 2, however showing a second embodiment of the invention.

With reference to the view of FIG. 5 the principles of the embodiment of FIGS. 1 thru 4 is applied to a caulking gun of slightly differing construction. More particularly, the caulking gun of the embodiment of FIG. 5 differs from that of the embodiment of FIGS. 1 thru 4 in the internal workings of the ejection member advance assembly. There is shown first and second handles 111 and 126 respectively. Upon the movement of handle 126 toward handle 111, handle 126 will pivot about point 129 thereby causing stop 128 to urge member 134 to the forward position indicated in phantom in FIG. 5. Thereby, spring 136 advances, applying pressure upon male element 124 and, thereby, upon canister 128. Conversely, when handle 126 is released relative to handle 111 no Pressure is applied upon element 134.

Following the release of handle 126, which is indicated by left arrow 140, the hand of the user is applied to member 132 so that, in like fashion to that explained with reference to FIG. 2, hole 135 in the center of element 132 will move to the position shown in phantom. Thereupon the friction between the surface of hole 135 and ejection member 122 is removed, the effect thereof being to permit spring 130 to expand in direction 137. The result thereof is similar to the above described process with reference to FIG. 4, i.e., the internal pressures within caulking canister 12 are removed by the effect of the relative vacuum formed by the movement to the right of male element 124 and with it the rear plate (not shown) of the canister 128.

Figure 6:
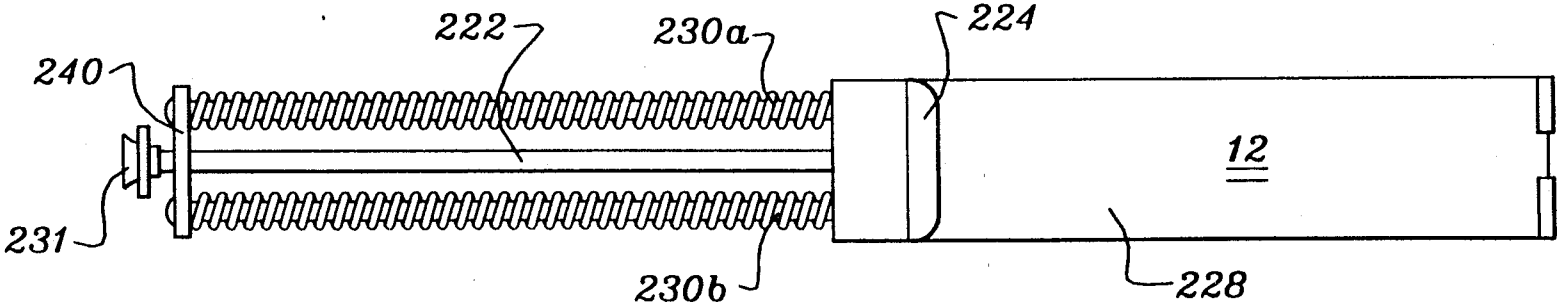
FIG. 6 is a top view of a third embodiment of the embodiment.

With reference to FIG. 6, there is shown a third embodiment of the present invention which may be used to retrofit either of the caulking gun models above described with reference to FIGS. 1 thru 5. In this embodiment springs **230*a* and 230*b* are provided as is element 240 and stop 231. This configuration represents an alternative configuration which may be used in lieu of the above described spring 30 in the embodiment of FIGS. 1 thru 4, and spring 130 in the embodiment of FIG. 5. The Primary value in the embodiment of FIG. 6 is the availability of additional or greater spring force for application against male element 224 and thereby against canister 12**.

It is to be appreciated that, in any of the above embodiments, the user may simply grasp ejection member 22 at or near the area of stop 31 or 231 and manually pull the member 22 backwards to achieve the desired effect, namely a relative vacuum in the canister 12.

Further, in lieu of the provision of female element 20 in the context of a retrofit method, back plate 18 may, as a part of the original assembly of the caulking gun, be formed or molded into the geometry of female element 20, thereby obviating the need to insert or bond a separate female element onto the back plate. Similarly, the end of the plunger of the caulking gun, that is, male element 24, may, in the course manufacture, be furnished with external threading complemental to the internal threading of the production-formed female element, as is shown in FIGS. 1A and 1B.

Accordingly, while there has been shown and described the preferred embodiment of the present invention it is to be appreciated that the invention may be embodied otherwise than in herein specifically shown and described without departing from the underlying ideas or principles of the invention within the scope of the claims appended herewith.

Having thus described my invention what I claim as new, useful and non-obvious and, accordingly, secure by Letters Patent of the United States is:

1. A method of prevention of over-ejection of compound from a caulking canister of a caulking gun having an ejection member passing through a body of the caulking system, the method comprising the steps of:

(a) permanently securing a female element onto a movable back plate of said canister;

(b) securing a male element, complementally securable to said female element, to an end of said ejection member normally in contact with said moveable back plate; and (c) securing, between said body of the caulking system at an opposite end of said ejection member, spring means to selectably urge the complementally secured male and female elements away from said caulking canister to thereby cause a relative vacuum therewithin, thusly reducing internal pressures in the canister that would otherwise cause over-ejection of compound from said canister.

2. The method as recite din claim 1 in which said securing Step (b) includes the step of rotating said male element to accomplish threaded complemental securement between said male and female elements.

3. A system for prevention of over-ejection of compound from a caulking canister of a caulking gun having an ejection member passing through a body thereof the system comprising:

(a) a female element permanently secured onto a moveable back plate of said canister;

(b) a male element, complementally securable to said female element, secured to an end of said ejection member normally in contact with said moveable back plate; and (c) spring means secured on said ejection member, between said body and an opposite end of said ejection member, for, after mutual securement of said male and female elements, selectably urging said back plate away from said caulking canister, thereby causing relative vacuum therewithin, reducing internal pressures in the canister that would otherwise cause over-ejection of compound from said canister.

4. The system as recited in claim 3, in which said male and female elements each comprise means for complemental securement by mutual threading means.

5. The system as recited in claim 3, in which said female element comprises said back plate of said canister.

6. The system as recited in claim 5 in which said male and female elements each comprise means for complemental securement by mutual threading means.

* * * * *